United States Patent [19]

Irvine et al.

[11] 4,020,615

[45] May 3, 1977

[54] ENVELOPE INSERTER AND FEEDER SYSTEM

[75] Inventors: Robert Irvine, Riverside; Harry E. Luperti, Wilton, both of Conn.

[73] Assignee: Pitney-Bowes, Inc., Stamford, Conn.

[22] Filed: Dec. 15, 1975

[21] Appl. No.: 641,027

[52] U.S. Cl. ..... 53/35; 53/67; 53/71; 53/186; 53/266 A

[51] Int. Cl.[2] ..... B65B 5/04; B65B 57/04

[58] Field of Search ..... 53/35, 266 A, 186, 187, 53/64, 67, 71

[56] References Cited

UNITED STATES PATENTS

| | | | |
|---|---|---|---|
| 3,423,900 | 1/1969 | Orsinger | 53/266 A X |
| 3,619,969 | 11/1971 | Holcombe | 53/187 X |
| 3,908,343 | 9/1975 | Farrelly | 53/187 X |

*Primary Examiner*—Othell M. Simpson
*Assistant Examiner*—Horace M. Culver
*Attorney, Agent, or Firm*—William D. Soltow, Jr.; Albert W. Scribner; Robert S. Salzman

[57] ABSTRACT

An apparatus and method is disclosed for inserting sheet material into a quantity of envelopes. The envelopes are conveyed in seriatim along a conveyor to an indexing drum. The envelopes are shingled and respectively overlap each other as they approach the drum. The indexing drum simultaneously receives one envelope from the conveyor, while discharging another envelope to an inserting deck. Each discharged envelope is restrained, and then sheet material is inserted therein. A sensor disposed upon the inserting deck, respectively senses each discharged envelope and provides a signal to actuate the inserting mechanism, and deactuate the indexing drive. When an inserted envelope leaves the deck, the sensor then actuates the indexing drive to cause the drum to discharge another envelope.

12 Claims, 5 Drawing Figures

ENVELOPE INSERTER AND FEEDER SYSTEM

This invention pertains to an envelope inserter and feeder system, and more particularly to an inserter system for envelopes that provides an increased output by reducing the travel and indexing motion of the envelopes.

BACKGROUND OF THE INVENTION

Envelope inserter and feeder machines such as models 3130-60 manufactured by Pitney-Bowes, Inc., of Stamford, Connecticut are limited in their output by the structural and inertial limitations of their moving parts. The movement of the envelopes and inserting rams have an upper limit, which clearly affects the output.

The present invention suggests a new method and apparatus which reduces the movement of the envelopes to increase the output of the system. The envelopes are rotatively indexed and discharged a short distance, thereby reducing inertial and structural effects in order to speed-up the process.

SUMMARY OF THE INVENTION

This invention pertains to an apparatus and method for inserting material into a quantity of envelopes.

The method of the invention includes the following steps: (a) delivering in seriatim a quantity of shingled envelopes that are overlapped with respect to each other, to an indexing drum; (b) rotatively indexing the drum such that the indexing drum will simultaneously receive one envelope and discharge another envelope for each indexing rotation thereof; (c) sensing the discharge of each envelope from the indexing drum, and respectively providing a signal indicative thereof; and (d) inserting material into each envelope discharged from the drum in response to each sensing signal.

The above method further includes the steps of: (e) transporting each inserted envelope away from the drum; (f) sensing the transportation of each inserted envelope, and providing a signal indicative thereof; and (g) rotatively indexing the indexing drum in response to each transportation signal.

The apparatus for carrying out the above method includes: (a) a conveyor that delivers a quantity of shingled envelopes to the indexing drum; (b) a rotative indexing drum that will simultaneously receive one envelope from the conveyor, while discharging another envelope to an inserting deck; (c) inserting means disposed adjacent the drum for engaging with a discharged envelope from the drum, and inserting material therein; (d) means for rotatively indexing the drum; and (e) means for sensing a discharged envelope, so as to deactuate the rotative indexing means and actuate the inserting means.

It is an object of this invention to provide an improved envelope inserter and feeder apparatus and method;

It is another object of the invention to provide an improved envelope inserter and feeder system wherein the output of the system is increased by reducing the feeding movement of the envelopes;

It is still another object of this invention to provide an improved envelope feeder and inserter system wherein the envelopes are rotatively indexed and discharged a short distance to reduce inertial and structural effects in order to speed up the process;

These and other objects of the invention will be better understood and will become more apparent with reference to the following detailed description taken in conjunction with the accompanying drawings, in which.

Figures 1, 5:
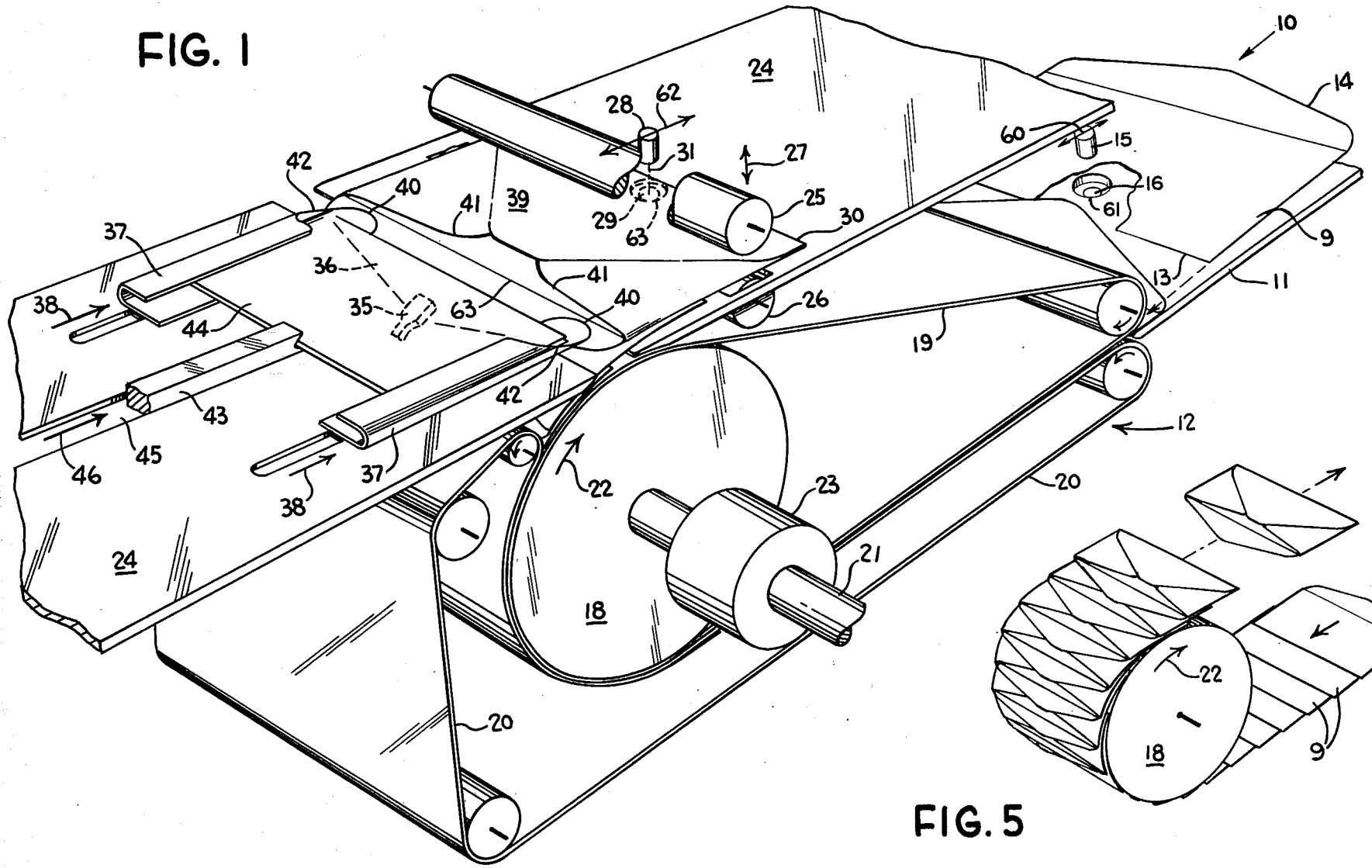
FIG. 1 is a perspective view of the envelope inserter and feeder system of this invention.
Figure 2:
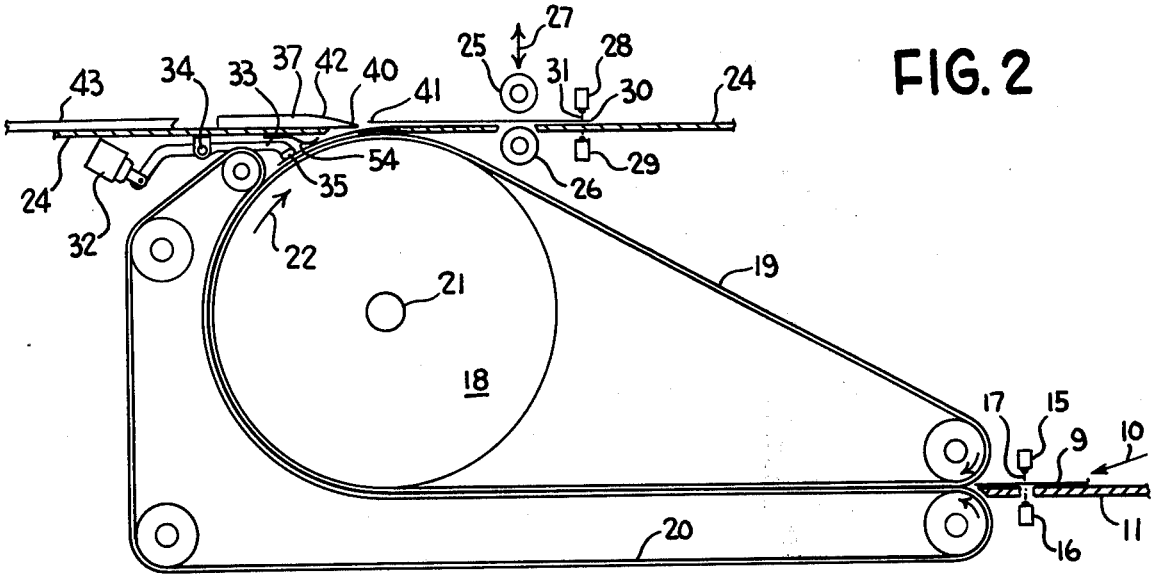
FIG. 2 is a side view of the inventive system shown in FIG. 1.
Figure 3:
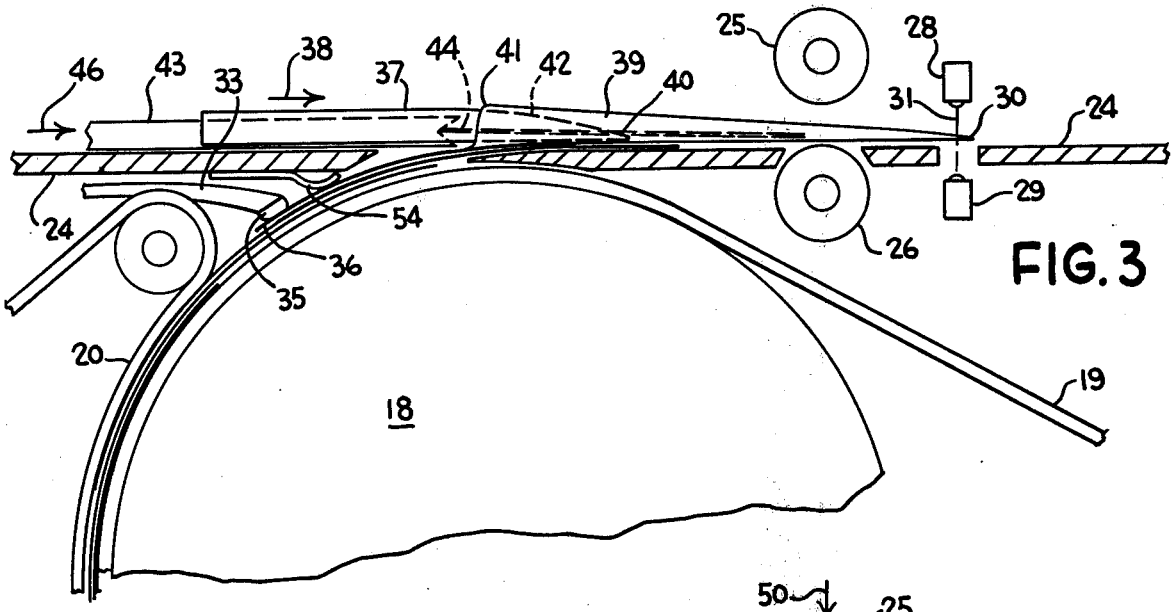
Figure 4:
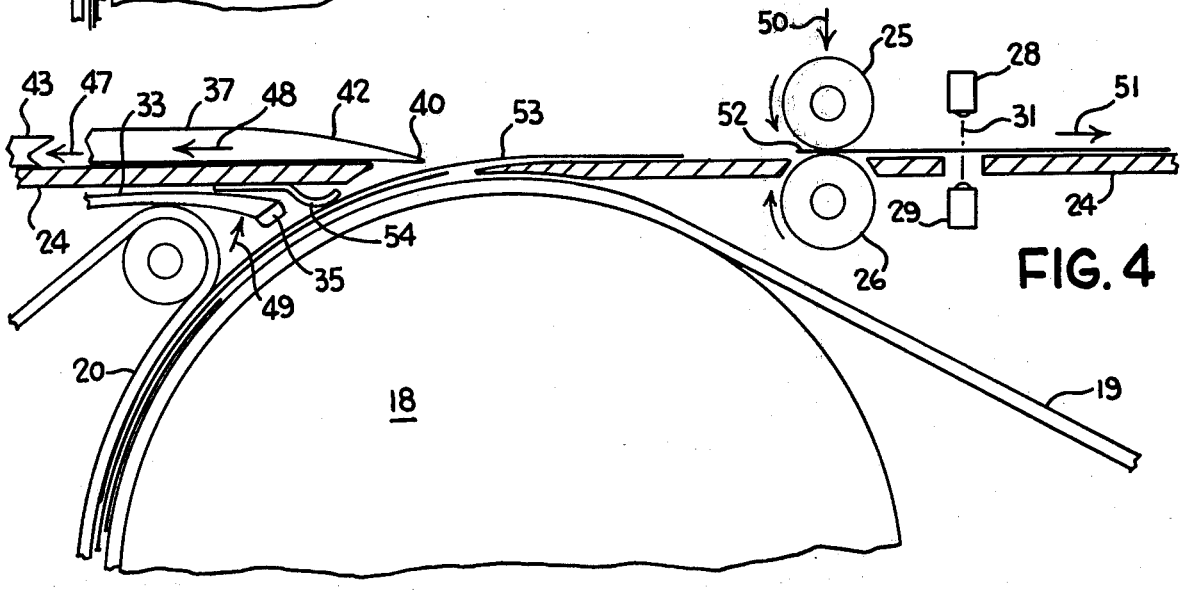

FIGS. 3 and 4 are enlarged side views of the discharge area of the inserter system of FIG. 2. FIG. 3 shows an envelope which has been discharged from the drum and which is being inserted with material; and FIG. 4 shows the inserted envelope being transported away from the indexing drum, and a subsequent envelope being discharged from the indexing drum; and FIG. 5 is a schematic view of the shingled envelopes traveling about the indexing drum of the inventive system shown in FIG. 1.

DETAILED DESCRIPTION

Now referring to FIGS. 1 and 2, a deflapped envelope 9 is depcited being deposited on top of, but lagging an envelope on the feed deck 11. The envelope 9 is caused to have forward movement (arrow 10), so as to carry it into the bite of a belted conveyor shown generally by arrow 12.

A photodetector 15 and light emitting diode 16 are disposed in the feed path of incoming envelopes prior to their entering conveyor 12. When the lead edge 13 (FIG. 1) of each incoming envelope breaks the light path 17 between the photodetector 15 and the LED 16, no new envelopes will be fed from an envelope feeder (not shown). The envelope feeder feeds only one deflapped envelope to deck 11 for each photodetector demand signal (a photodetector signal is provided each time the photodetector 15 sees light).

As the trailing edge 14 of the envelope passes the light path 17, as when the envelope is caught in the bite of the conveyor 12, the envelope feeder is actuated into feeding another envelope towards deck 11. This photoelectric feeding control provides that the envelopes 9 traveling along the conveyor 12 towards indexing drum 18, are caused to be shingled in an overlapping manner as schematically illustrated in FIG. 5. The amount of overlap can be controlled by moving photocell No. 15 up or down stream as will be explained hereinafter.

The upper belt 19 of the conveyor 12 is wrapped around indexing drum 18. The lower belt 20 of the conveyor, stays in contact with belt 19 for a portion of its travel, and is also partially wrapped about drum 18.

Indexing drum 18 is rotatively driven (arrow 22) via the continuously rotating shaft 21. Shaft 21 is driven by a motor (not shown). Electrical clutch 23 (FIG. 1) clutches in the drive to allow the drum 18 to have an intermittent, indexing capability. As will be explained in more detail hereinafter, every time the drum 18 is rotatively indexed, it simultaneously receives one envelope from the conveyor 12, while discharging another envelope to an inserting deck 24.

A discharged envelope is caused to travel between a pair of rollers 25 and 26, respectively, disposed about deck 24. The lower roller 26 is rotatively fixed, while the upper rotatable roller 25 is vertically movable as shown by arrows 27. When an envelope is discharged from the drum 18, the upper roller 25 is in an upper position. This provides a gap between the rollers 25 and 26 through which the envelope can pass.

A photodetector 28 and a light emitting diode 29 are disposed about deck 24 on the downstream side of the rollers 25 and 26. When a discharged envelope passes between the rollers 25 and 26, its leading edge 30 will break the light path 31 between the photodetector 28, and the light emitting diode 29. The photodetector 28 will then provide a signal to deactuate clutch 23, causing drum 18 to stop.

A solenoid 32 (FIG. 2) disposed below deck 24 is actuated by the signal of photodetector 28, and causes pivot arm 33 to pivot in a clockwise diretion about the pivot 34. The nose 35 of the pivot arm 33 has a frictional surface which engages with, and holds, the flap portion 36 of the discharged envelope against drum 18, when the arm 33 is caused to pivot (FIGS. 1 and 3).

A pair of U-shaped fingers 37 are then advanced towards (arrows 38) the body portion 39 of the discharged envelope. The tips 40 of the fingers 37 are curved downwardly so as to slip under the edges 41 of the body portion 39 of the envelope. The fingers are thrust into the pocket of the envelope. In so doing, the curved surfaces 42 of the fingers spread the pocket as the mouth of the pocket (edges 41) ride up on surfaces 42.

A ram 43, guided in track 45 of the deck 24, then pushes (arrow 46) an insert 44 into the open pocket of the envelope. The insert material may comprise one or more sheets, cards, folded circulars, etc. or combinations thereof. The insert material is guided into the envelope pocket without skewing or jamming. This is due to the fact that the insert 44 slides between the U-shaped fingers 37.

Then, the solenoid 32 is caused to deactuate, which allows the arm 33 to return to its rest position (arrow 49; FIG. 4). The stuffed envelope is now free to leave the inserting deck 24. This is accomplished by means of rollers 25 and 26. Roller 25 is now caused to descend (arrow 50) vertically into contact with the body 39 of the envelope as shown in FIG. 4. As the roller 25 moves downwardly, a rotative drive (not shown) is engaged to rotate roller 25.

The inserted envelope now being in the rotative bite of rollers 25 and 26, is caused to be transported (arrow 51) from the deck 24. Another pair of take-away rollers downstream of rollers 25 and 26 (not shown) will carry away the inserted envelope before rollers 25 and 26 open. After the envelope is in the bite of rollers 25 and 26, the ram 43 and the fingers 37 respectively retract (arrows 47 and 48, of FIG. 4).

When the trailing edge 52 of the envelope passes the light path 31, photodetector 28 then begins to conduct again. Roller 25 is returned to its upper position, and clutch 23 is actuated to clutch-in drive shaft 21. Drum 18 is now caused to rotate, and will continue to do so until a subsequent envelope 53 (FIG. 4) will break the light beam 31.

A spring 54 or other retaining means is attached to the underside of deck 24. This spring acts to hold the envelopes to the drum 18, after they leave the retaining confinement of belt 20. Spring 54 is needed to provide the proper envelope flow onto deck 24.

As aforementioned, the conveyor belt 19 is wrapped about the drum 18. This is done for the purpose of making the conveyor movement synchronous with the indexing rotation of the drum. In other words, the conveyor will only move when the drum turns. This insures that for each indexing of the drum, there is a simultaneous receipt and discharge of an envelope. Naturally this belt and drum arrangement is but one way of accomplishing this synchronism.

In order to vary the overlap distance between the incoming envelopes 9 (FIGS. 1 and 5), the photodetector 15 and the LED 16 may be mounted to be laterally movable (arrows 60). If this is done, the hole 61 in the deck can have the shape of a slot that is elongated in the direction of movement.

The photodetector 28 is also made to be laterally movable, as shown by arrows 62. This would provide that the crease line 63 of the envelope would always be in proper registration with the spreading fingers 37, for all sizes of envelopes. Naturally, the light source 29 must also be movable along with photodetector 28, and the aperture 63 in deck 24 must have the shape of an elongated slot.

OPERATION OF THE INVENTION

When the inventive system is initialized, there is no envelope blocking the light path 31 on the inserting deck 24 of FIG. 1. This causes a continuous rotation of drum 18, since clutch 23 is continuously actuated. Because drum 18 is rotating continuously at the start, conveyor 12 which is synchronously tied to the drum 18, is likewise continuously running. Envelopes 9 will be continuously carried away from the feed-in deck 11 as they arrive. The overlapping of the envelopes (shingling) will, however, be accomplished due to the intermittency of feeding caused by the blocking and unblocking of photodetector 15.

As the drum and conveyor continue to operate, the shingled envelopes will wrap around the drum as illustrated in FIG. 5. The drum and the conveyor will only be brought to a stop when the first envelope is discharged from the drum and breaks the light beam 31. Naturally, when an envelope blocks light path 31, no further envelopes will be fed towards the conveyor 12. This is so, because when the drum and conveyor is stopped, the envelope 9 blocking light path 17 will not be carried away. Therefore, no new envelopes will be supplied to deck 11.

The fact that photodetectors 15 and 28 are operatively tied to each other, insures that there will always be a steady and uniform flow of envelopes about the drum.

As aforementioned, when an envelope breaks light beam 31, clutch 23 is deactuated disconnecting the drive shaft 21 from the drum 18. The drum stops, and then solenoid 32 (FIG. 2) actuates to pivot the arm 33 into restraining the flap 36 of the discharged envelopes.

Next, the envelope body 39 is spread open by the advancing fingers 37 as illustrated in FIGS. 1 and 3.

Following the opening of the mouth (edge 41) of the envelope, the ram 43 moves forward to fill the envelope with an insert. The solenoid 32 (FIG. 2) is deactuated freeing the flap 36 of the envelope, after the envelope is stuffed.

Next, roller 25 is caused to move downwardly as depicted in FIG. 4. The stuffed envelope now becomes caught in the rotative bite of the rollers 25 and 26. The inserted envelope is thus caused to be rejected from the deck 24.

Then, the fingers 37 and ram 43 are retracted.

As the trailing edge 52 (FIG. 4) of the envelope moves past the light beam 31, the photodetector begins to conduct, causing the clutch 23 to actuate. Roller 25 will now return to its upper position, thus allowing a subsequent envelope to pass between the rollers 25 and 26.

The drum 18 will discharge a subsequent envelope, and will stop rotating when this envelope breaks the light beam 31. The inserting cycle now repeats itself.

It will be seen, that the output speed of this inventive inserting and feeding system can be greatly increased. This is so, because the discharging envelopes are easily and quickly brought into an inserting position, i.e., each discharged envelope only requires a short indexing travel. Thus, the output is increased.

It should be noted, that the short distance traversed by the discharging envelopes, is a direct result of the shingling (overlapping) of the envelopes.

Many modifications and changes of an obvious nature will naturally occur to the skilled practitioner of this art. All such changes are deemed to lie within those limits defining the spirit and scope of the invention, as presented by the appended claims.

What is claimed is:

1. An envelope inserter and feeder system, comprising:

delivery means for delivering in seriatim a quantity of envelopes to an indexing drum, said delivery means including means for shingling the envelopes such that they overlap each other as they are delivered to said drum;

an indexing drum rotatably mounted adjacent said delivery means for receiving envelopes from said delivery means as said drum is rotatively indexed, said drum simultaneously receiving one envelope and discharging another envelope, for each indexing rotation thereof;

indexing means operatively connected to said drum for rotatively indexing the drum;

inserting means disposed adjacent said drum for engaging with a discharged envelope from said drum and inserting material into said discharged envelope; and sensing means disposed adjacent said drum in a path of said discharged envelope, said sensing means being operatively connected to said indexing means and said inserting means, whereby as said drum discharges an envelope, said sensing means senses the discharged envelope and causes said indexing means to deactuate, and said inserting means to actuate so as to insert material into said discharged envelope.

2. The envelope inserter and feeder system of claim 1, further comprising:

transporting means disposed adjacent said sensing means, said transporting means engaging with an inserted envelope and carrying the inserted envelope away from said sensing means, whereby said sensing means senses the absence of the inserted envelope and actuates the indexing means to cause said drum to discharge another envelope therefrom.

3. The envelope inserter and feeder system of claim 1, wherein said delivery means includes a conveyor, and further wherein said conveyor is synchronously movable in conjunction with said indexing drum.

4. The envelope inserter and feeder system of claim 3, wherein said conveyor comprises at least one movable belt, and further wherein one of said belts is wrapped about said indexing drum.

5. The envelope inserter and feeder system of claim 1, wherein said inserting means comprises a deck upon which the envelope discharged from the drum is disposed prior to having material inserted therein.

6. The envelope inserter and feeder system of claim 1, wherein said sensing means comprises an optical sensor.

7. The envelope inserter and feeder system of claim 1, wherein said indexing means comprises a clutched drive.

8. The envelope inserter and feeder system of claim 2, wherein said transporting means comprises a pair of rollers, one roller of said pair being a driving roller, and the other roller of said pair being a rotatably fixed roller, said drive roller being movable into, and out of, engagement with said fixed roller.

9. The envelope inserter and feeder system of claim 1, further comprising:

envelope restraining means disposed adjacent said indexing drum and operatively connected to said sensing means, wherein a discharged envelope will be held in place while the inserting means inserts material into said discharged envelope.

10. A method of inserting material into a quantity of envelopes, comprising the steps of:

a. delivering in seriatim a quantity of shingled envelopes, that are respectively overlapped in regard to each other, to an indexing drum;

b. rotatively indexing said indexing drum such that said drum will simultaneously receive one envelope and discharge another envelope for each indexing rotation thereof;

c. sensing the discharge of each envelope from the indexing drum and respectively providing a signal indicative thereof; and d. inserting material into each envelope discharged from said indexing drum in response to each sensing signal.

11. The method of claim 10, further comprising the steps of:

e. transporting each inserted envelope away from said drum;

f. sensing the transportation of each inserted envelope and providing a signal indicative thereof; and g. rotatively indexing said indexing drum in response to each transportation signal.

12. The method of claim 11, further comprising the step of:

e. restraining each discharged envelope prior to inserting material therein.

* * * * *